United States Patent [19]

McClure

[11] 4,073,103

[45] Feb. 14, 1978

[54] BUILDING STRUCTURE AND METHOD OF CONSTRUCTION

[76] Inventor: Charles Michael McClure, P.O. Box 11165, Tahoe Paradise, Calif. 95705

[21] Appl. No.: 691,362

[22] Filed: June 1, 1976

[51] Int. Cl.[2] ..... E04B 7/12

[52] U.S. Cl. ..... 52/93; 52/263; 52/643; 52/720; 52/741

[58] Field of Search ..... 52/90, 93, 263, 643, 52/741, 720

[56] References Cited

U.S. PATENT DOCUMENTS

| | | | |
|---|---|---|---|
| 1,342,021 | 6/1920 | Jennings | 52/90 |
| 1,421,299 | 6/1922 | Palen | 52/93 |
| 2,270,161 | 1/1942 | Briggs | 52/263 X |
| 3,008,195 | 11/1961 | Coffey | 52/93 |
| 3,662,502 | 5/1972 | Wright | 52/93 |
| 3,986,306 | 10/1976 | Trannoy | 52/93 X |

FOREIGN PATENT DOCUMENTS

| | | | |
|---|---|---|---|
| 1,077,338 | 4/1954 | France | 52/263 |

*Primary Examiner*—Alfred C. Perham
*Attorney, Agent, or Firm*—Phillips, Moore, Weissenberger, Lempio & Majestic

[57] ABSTRACT

A building structure is disclosed which comprises a plurality of novel prefabricated joist trusses, a plurality of conventional gable trusses each associated with a different joist truss and a pair of conventional prefabricated exterior end walls together with conventional flooring, interior walls, exterior sheeting and roofing. The method of constructing such building structure is described which method includes the steps of first assembling the plurality of joist trusses on a foundation, then applying the side wall sheeting and subfloor to the joist trusses, then installing the interior walls and exterior end walls, then assembling the gable trusses with the joist trusses and finally sheeting and roofing the gable trusses, extending the roofing over the side wall sheeting if desired.

15 Claims, 14 Drawing Figures

BUILDING STRUCTURE AND METHOD OF CONSTRUCTION

BACKGROUND OF THE INVENTION

This invention relates to a building structure and method of constructing it and more particularly to a building structure and method which is particularly suited for limited usage at a remote site.

Where a number of buildings are to be erected at an easily accessible site, it is possible to prefabricate such buildings in large sections for transportation to such site and rapid assembly at the site using heavy equipment. However, where a limited number of buildings are to be erected at a remote site, it becomes impractical to use heavy machinery at the site and the size of the prefabricated unit which can be transported to and handled at the site is limited.

It is a primary object of this invention to provide a building structure and construction method which will not require heavy equipment at the construction site and yet will enable rapid assembly of prefabricated, easily transportable sections essentially by hand.

Portable temporary building structures have been proposed in the prior art. However, the structural elements and construction methods for such buildings are not suitable for use in erecting permanent buildings.

It is another object of this invention to provide an improved permanent building structure and an improved method of quickly constructing such building structure at a remote site of prefabricated sections which can be handled essentially by hand.

A further object of this invention is a building structure and construction method which will provide improved structural strength and ruggedness.

A still further object of this invention is a building structure and construction method which will require reduced building materials and provide a building with improved insulating characteristics.

Still another object of this invention is a building structure and construction method which will reduce the requirement for both labor and heavy equipment at the construction site.

SUMMARY OF THE INVENTION

Briefly, in the building structure and construction method according to this invention, a plurality of joist trusses are fabricated each comprising a joist member of given common length having a floor supporting surface. The joist trusses each include a first pair of elongated wall members of given common length extending normally to the floor supporting surface of the joist member and each has one end rigidly fixed to the joist member at a point spaced a given common distance from a different end of the joist member. Each joist truss also includes a second pair of elongated wall members each extending only between the free end of a different one of the first pair of elongated wall members and the free end of the joist member adjacent thereto, with its ends rigidly fixed to such free ends of the elongated wall and joist member, respectively. A plurality of conventional gable trusses are also fabricated with a span capable of bridging the spacing between the first pair of wall members of each truss.

The plurality of joist trusses are arranged with the joist members thereof parallel to each other in a common plane, with their ends in alignment and with the first elongated wall members thereof extending vertically. Conventional sheeting is then applied to the exterior surfaces of the second elongated wall members of the joist trusses and conventional subflooring is applied to the floor supporting surface of the joist members to form an open ended, open top, box-like structure.

Conventional interior wall framing and conventional exterior end walls are then installed. Subsequently, each gable truss is assembled with a different joist truss in vertically spaced parallel relation to the joist member thereof and with the ends of the gable truss in abutment with the elongated wall members thereof and the ends of the gable truss are rigidly fixed to the abutting elongated wall members.

Conventional sheeting is then applied to the exterior surface of the gable trusses. Finally, conventional roofing is applied to the sheeting on the roof and walls and the interior of the structure is finished in the conventional manner.

BRIEF DESCRIPTION OF THE DRAWING

The foregoing and other objects and features of the subject invention will become more clearly apparent from the following detailed description of a preferred embodiment thereof when read in conjunction with the attached drawing wherein.

DETAILED DESCRIPTION OF PREFERRED EMBODIMENT

Figure 1:
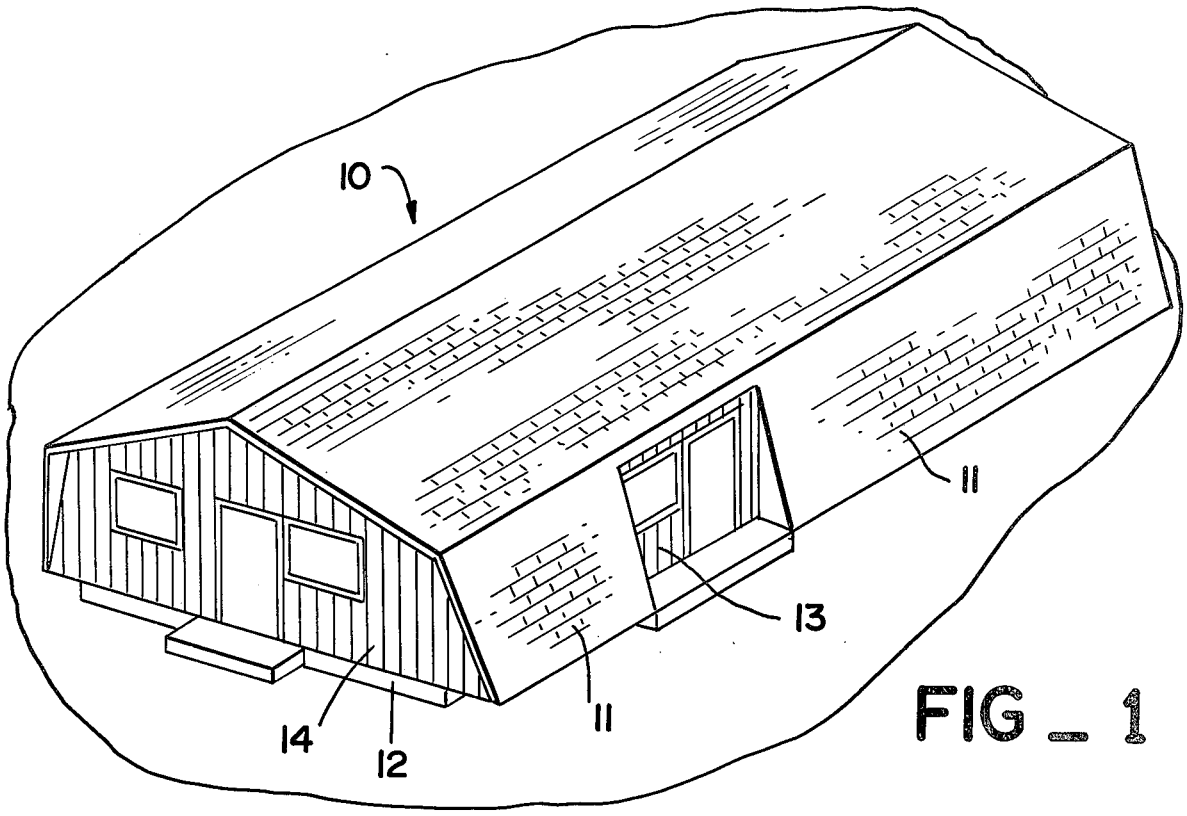
FIG. 1 is a perspective view of a completed building according to one embodiment of this invention.
Figure 2:
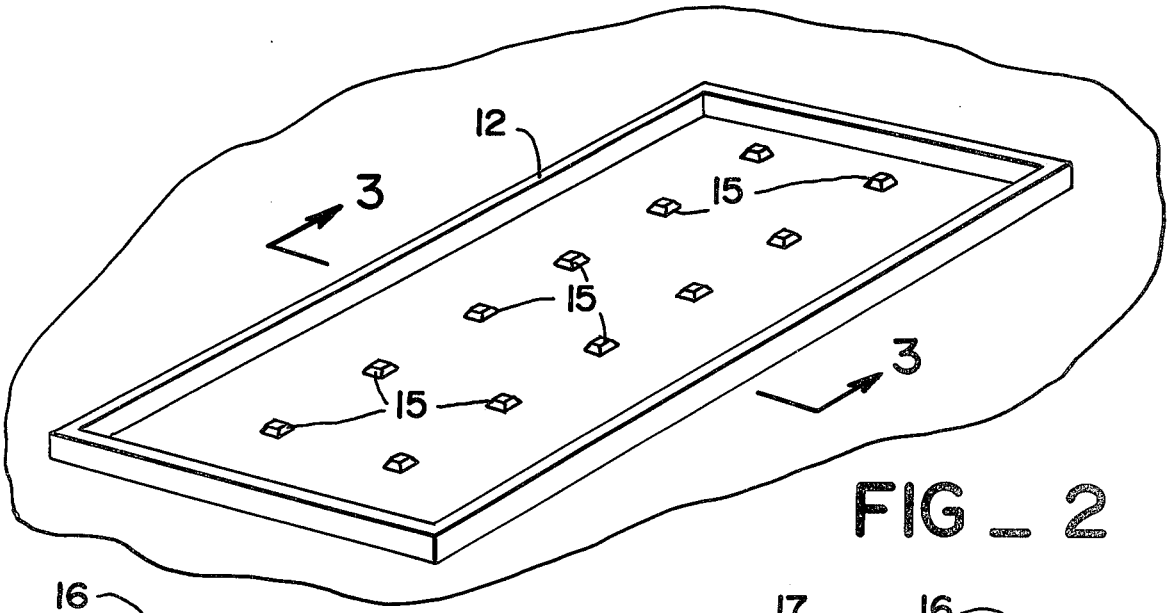
FIG. 2 is a perspective view of the foundation for the building of FIG. 1.
Figure 3:
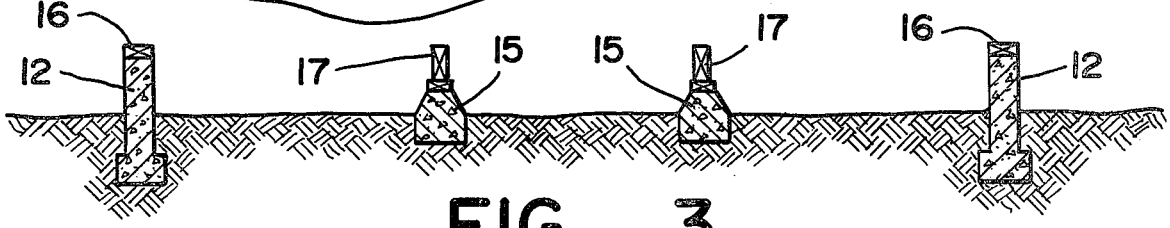
FIG. 3 is an enlarged cross-sectional view of the foundation of FIG. 2 taken along line 3—3 and showing the mud sills and the girders in place on the foundation.

Referring to FIG. 1, a building structure 10 constructed in accordance with one embodiment of this invention is shown. A characteristic feature of buildings constructed in accordance with the teaching of this invention is the sloping side wall 11 resulting from an essential feature of the subject invention. The building structure 10 is constructed on a more or less conventional foundation 12 and may include one or more pre-framed exterior side walls 13 as well as pre-framed exterior end walls 14.

According to the preferred embodiment of the teaching of this invention, a plurality of poured concrete posts 15 are provided within a poured concrete foundation 12. The foundation 12 may have a width of 24 feet (7.2 meters) and a length of 36 feet (11 meters), for example, and the posts 15 may be arranged in two rows extending the length of the foundation 12, which rows are spaced from each other by about 8 feet (2.4 meters) and each spaced about the same distance from a different one of the sides of the foundation 12. An appropriate wooden mudsill 16 is bolted to the top of the foundation 12. A pair of girders 17 are each mounted on a different row of posts 15 and extend the full length of the foundation 12. The girders 17 are preferably 4 inch × 6 inch timbers (10cm × 15 cm) mounted on edge and leveled at their upper side with the top surface of the mudsill 16 which is preferably made of 2 inch × 6 inch (5.1cm × 15 cm) timbers mounted flat on the foundation 12.

Figure 6:
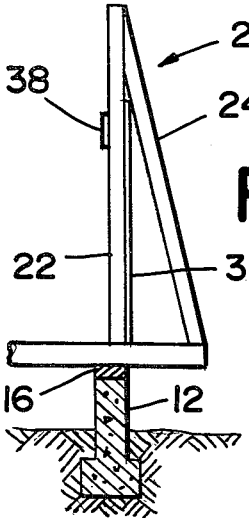
FIG. 6 is a side view in elevation and partly in cross-section taken along line 6—6 of FIG. 5.
Figure 7:
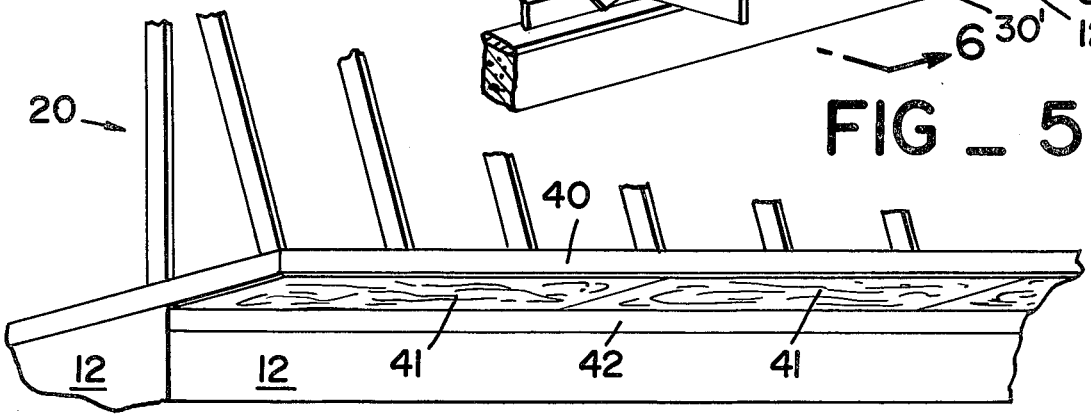
FIG. 7 is a fragmentary perspective view of the completed assembly of floor joists on the mud sills and girders of the foundation from below to show the soffits as applied to the underside of the overhanging portions of the joist truss assembly.
Figure 8:
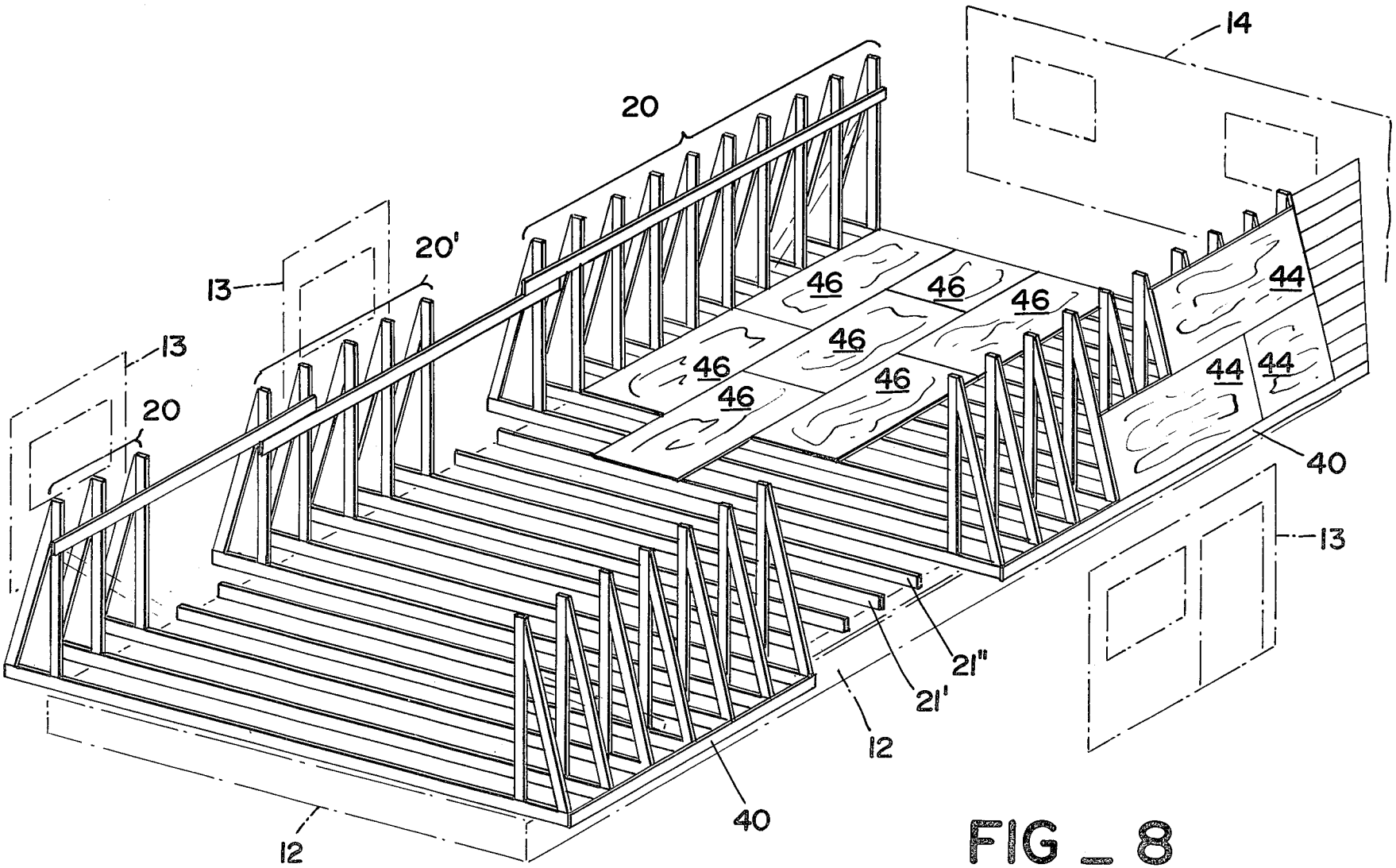
FIG. 8 is a perspective view of the structure after the assembly of the joist trusses on the foundation with a portion of the sheeting and a portion of the subflooring shown in place and pre-framed side and end walls shown in phantom.

As best shown in FIGS. 4 through 8, the characteristic feature of the subject invention is the installation of a plurality of novel joist trusses 20 spaced along the length of the foundation 12. Basically, the joist trusses 20 include a joist member 21 having a length sufficient to overhang the foundation by a given amount at both ends. However, as best shown in FIG. 8, a few joist trusses 20' may include a joist member 21' having a length dimensioned to overhang the foundation by the given amount at one end only for use in special situations as will be more fully discussed hereinbelow. Similarly a simple joist member 21'' may be substituted for the novel joist truss 20 or 21' of this invention in specific situations. In the preferred embodiment of this invention, the joist members 21, 21' and 21'' are edge oriented 2 inch × 6 inch (5.1cm × 15 cm) timbers.

Thus, according to this invention, a plurality of prefabricated joist trusses 20 together with a number of pre-fabricated joist trusses 20' as required by the particular design of the structure being constructed are transported to the construction site and installed on the foundation together with simple joist members 21'', as required. Each of the joist trusses 20 includes an upright interior wall member or stud 22 rigidly connected to the upper edge of the joist member 21 by fastening with connector plates at points spaced inwardly from each end of the joist member 21 to overlie the foundation 12. The studs 22 extend perpendicularly to the joist members 21 and have a length equal to the desired ceiling height which may be, for example, about 8 feet (2.4 meters). An exterior wall member 24 extends between the free end of each stud member 22 and the free end of the joist member 21 adjacent thereto. The exterior wall member 24 is rigidly fixed at its opposite ends to the free end of the stud member 22 and the free end of the joist member 21, respectively, by means of appropriate connector plates. The joist trusses 21' have a stud member 22 and exterior wall member 24 at one end only.

The interior wall members or studs 22 are preferably made of 2 inch × 4 inch (5.1cm × 10 cm) timbers and the exterior wall members 24 are preferably made of 2 inch × 6 inch (5.1cm × 15 cm) timbers. The given distance by which the joist members 21, 21' overhang the foundation at their ends is preferably about 2 feet (0.6 meter) where the length of the stud 22 (and thus the ceiling height of the constructed building, is about 8 feet (2.4 meters). Thus, the exterior wall member 24 forms an angle of about 15° with respect to the stud 22 and an angle of about 75° with respect to the joist member 21. The triangle formed by the stud 22 and exterior wall member 24 with the overhanging portion of the joist member 21 may be scaled up or down. However, it will be seen that if the angle formed between the exterior wall member 24 and the stud 22 is increased, it will tend to increase the requirement for building materials without adding appreciably to the usable space within the structure whereas, if the angle formed between the exterior wall member 24 and the stud 22 is decreased, it will tend to reduce the structural strength of the joist truss with respect to lateral loads.

Before describing the specific steps for the installation of the joist trusses 20 on the foundation 12, attention is directed to the fact that elongated filaments 26, which may be strings or wires extending the length of the foundation on 12 inch (31 cm) centers and fastened to the mudsill at the ends of the foundation, may be installed prior to installing the joist trusses 20. Such filaments 26 may be stapled to the bottom of every other joist member 21 of the joist trusses after installation thereof and together with the girders 17 will provide a grid-like support for insulation which will eventually be laid between the joist members 21. One end of such filaments 26 have been shown in FIG. 4 but are omitted from other figures of the drawing for purposes of clarity. In an actual embodiment of this invention No. 18 nylon twine has been used as the filament 26.

Figure 4:
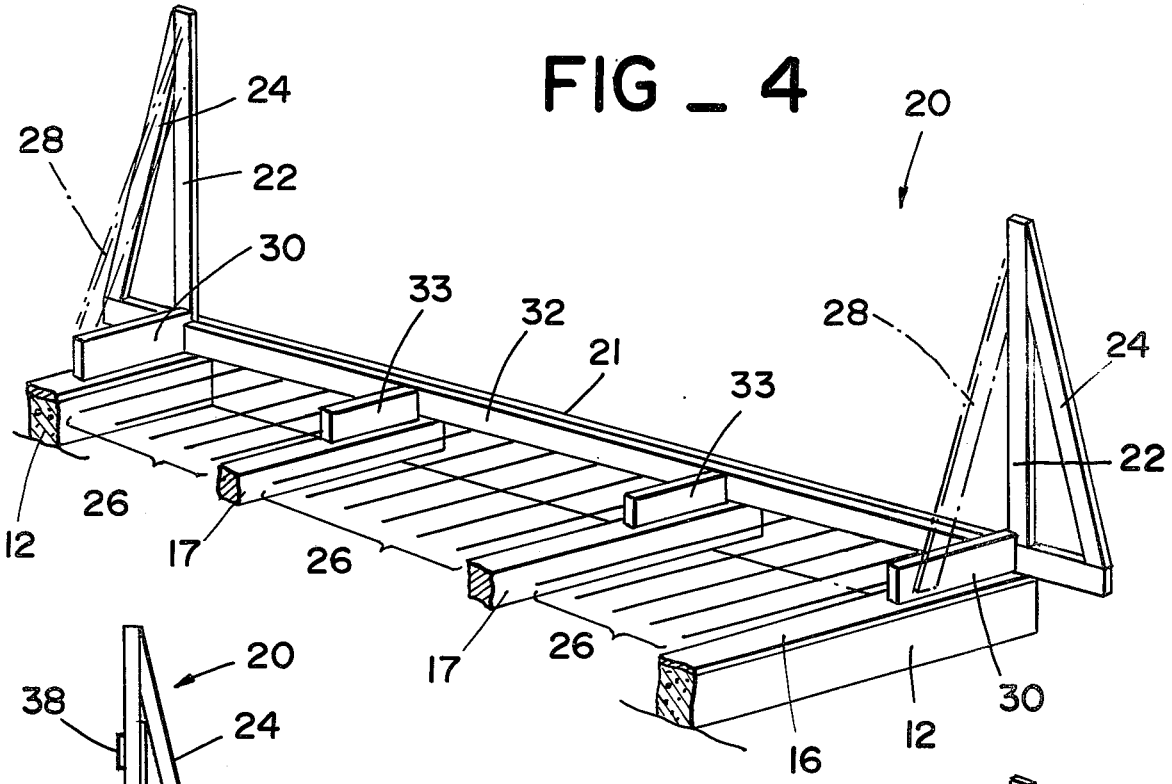
FIG. 4 is an enlarged fragmentary perspective view showing the first joist truss as positioned on the mud sills and girders of FIG. 3.

The installation of the joist truss members may begin at either end of the foundation with the positioning of the first prefabricated joist truss 20 as shown in FIG. 4. The first joist truss is aligned with the exterior edge of the mudsill and positioned with the stud 22 in a vertical position. The joist member 21 may be toenailed into place and a temporary brace 28 may be installed as shown. A pair of 2 inch × 8 inch (5.1 cm × 20 cm) end blocks 30, each overlying one side of the foundation 12, are then positioned with one end in contact with the joist truss 20, as shown in FIG. 4. The blocks 30 are then firmly affixed to the mudsill 16 and the joist truss 20 as by nailing through the joist member 21 into the block 30 and toenailing the block 30 to the mudsill.

A doubler joist 32 is then positioned in contiguous contact with the inner side surface of the joist member 21 of the first joist truss 20 and a pair of 2 inch × 6 inch (5.1 cm × 15 cm) blocks 33 are positioned on the girders with one end in contact with the doubler joist 32, as shown in FIG. 4. The blocks 33 are rigidly affixed to the joist member 21 and doubler joist 32 as well as to the girders by appropriate nailing, for example.

Figure 5:
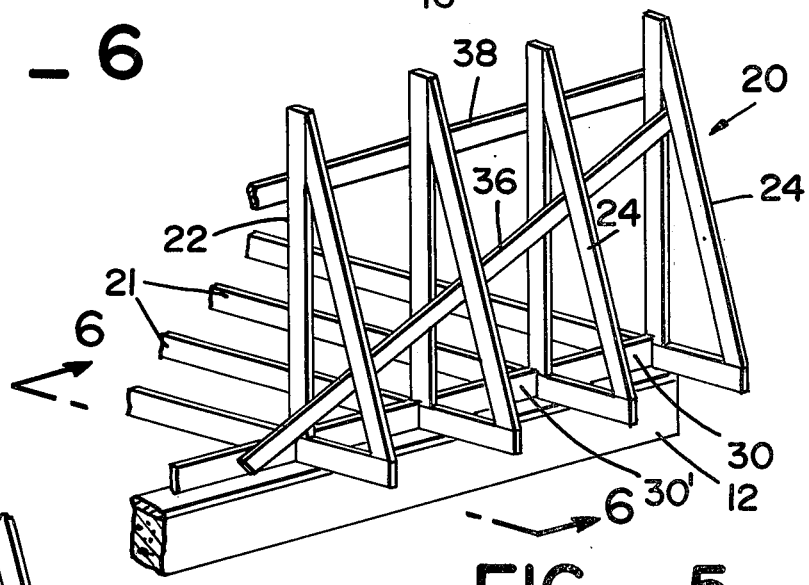
FIG. 5 is an enlarged fragmentary perspective view similar to FIG. 4 but showing the right hand end portion only of a plurality of joist trusses as positioned on the mud sills and girders of the foundation of FIG. 3.

The next joist truss 20 is positioned on the mudsill in parallel alignment with the first joist truss 20 and the foregoing procedure is repeated. Subsequent end blocks 30' positioned over the sides of the foundation 12 will, of course, have the same length as subsequent blocks 33 whereas the first pair of blocks 33 are shorter by an amount equal to the thickness of the doubler joist 32. The blocks 30' and 33 between subsequent joist trusses 20 may be staggered to facilitate nailing thereof and after four joist trusses have been installed on the foundation, a permanent sway brace 36 may be installed within the triangle formed by the studs 22 and exterior wall members 24 as shown in FIGS. 5 and 6. In addition, a temporary nailer brace 38 may be installed on the inside of the studs 22 as shown in FIGS. 5 and 6 to increase the stability of the assembly prior to the application of sheeting on the exterior of the exterior wall members 24 to be described. The temporary brace 28 may then be removed.

Steps should be taken to insure that the studs 22 of each of the joist trusses 20 are plumb and that the overhanging ends of the joist members 21 of the joist trusses are in alignment. The joist members 21 of the joist trusses should, of course, be parallel to each other and the joist trusses are preferably installed on 24 inch (0.6 meter) centers.

Referring to FIG. 7, when all of the overhanging joist trusses 20 have been installed, an appropriate facia 40 may be applied to the projecting ends of the joist members 21 and an appropriate soffit material may be affixed to the bottoms of the overhanging portions of the joist members 21. The facia 40 and soffit 41, as well as a soffit trim applied to the mudsill will tend to hold the assembly of joist trusses 20 rigidly in position during the subsequent installation of groundwork plumbing and heating installation prior to the application of the sheeting to the exterior of the exterior wall members 24.

Figure 9:
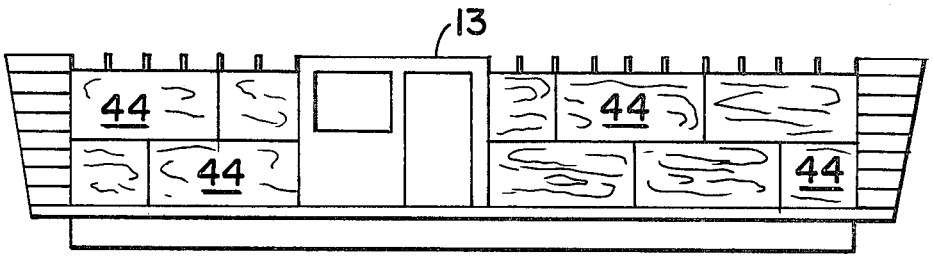
FIG. 9 is a reduced side view in elevation of the structure of FIG. 8 after installation of the pre-framed exterior side door wall and sheeting.
Figure 10:
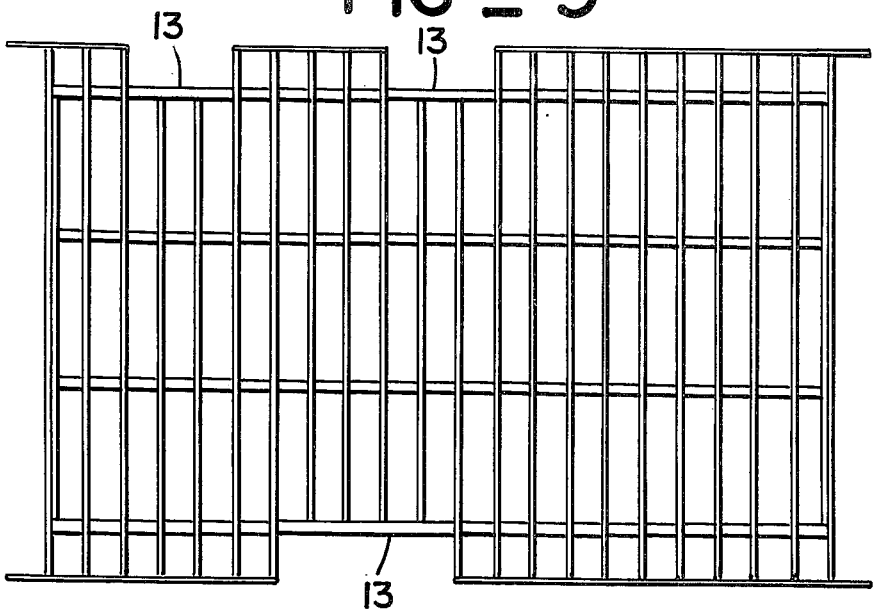
FIG. 10 is a plan view of the structure of FIG. 9 showing that the exterior side walls may be installed prior to installation of the subflooring.

Referring to FIGS. 8, 9 and 10, the next step in the preferred embodiment of this invention is to apply sheets 44 of commercially available plywood such as CDX Plywood to the exterior surfaces of the exterior wall members 24 of the joist trusses 20, 20' thus tying the joist trusses into a rigid supporting structure. The pre-framed exterior window and door side walls 13 may then be installed in the spaces provided by the joist trusses 20' in cooperation with simple joist members 21'' as required.

The floor insulation is then installed and the groundworks for the plumbing and heating inspected, if necessary, after which the subflooring may be installed. The subflooring is preferably commercially available ¾ inch (2 cm) plywood sheets 46 which are laid prior to the installation of the pre-framed exterior end walls 14 (only one of which is shown in FIG. 8).

As shown at the right hand end of FIG. 8 and in FIG. 9, an appropriate overhang may be provided at the ends of the structure by applying exterior grade plywood between the first and second joist trusses at each end of the structure. This is preferably done after installation of the exterior end walls 14 and thus the sheeting 44 should be started at the center of the second joist truss at each end of the structure.

Figure 11:
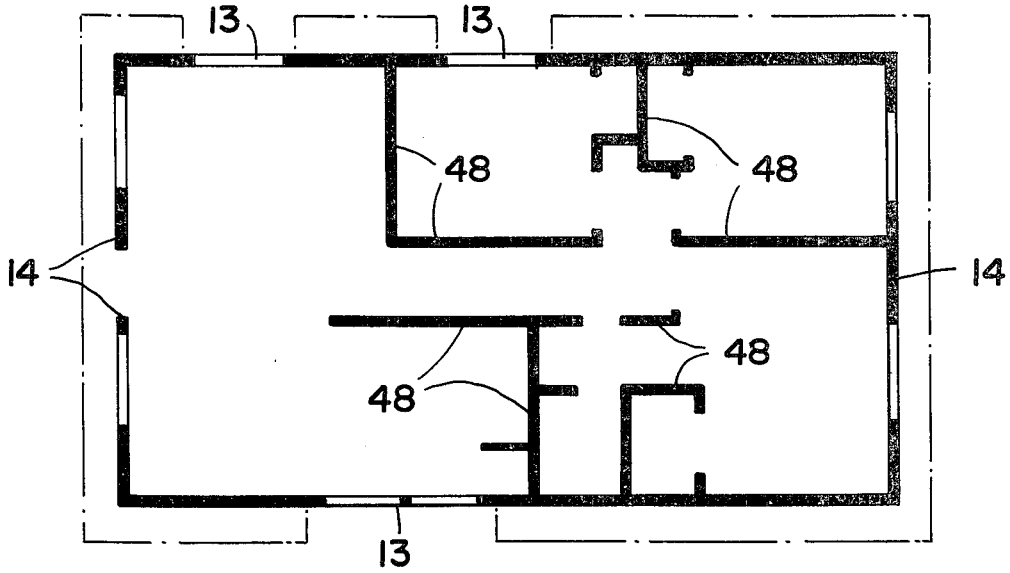
FIG. 11 is a floor plan of the structure of FIG. 9 showing one arrangement of interior walls which may be framed prior to installation of the exterior end walls.

Referring to FIG. 11, a typical arrangement of interior walls 48 is shown. The interior walls 48 are preferably laid out and framed after installation of the first exterior end wall 14 but before installation of the second exterior end wall 14. The installation of appropriate fire blocks between the studs 22 and in the interior walls may be carried out in conjunction with the installation of the interior walls and similarly it will be understood that supporting blocks may be inserted between the joist members 21 in conjunction with the application of the subflooring as necessary or desirable.

Figure 12:
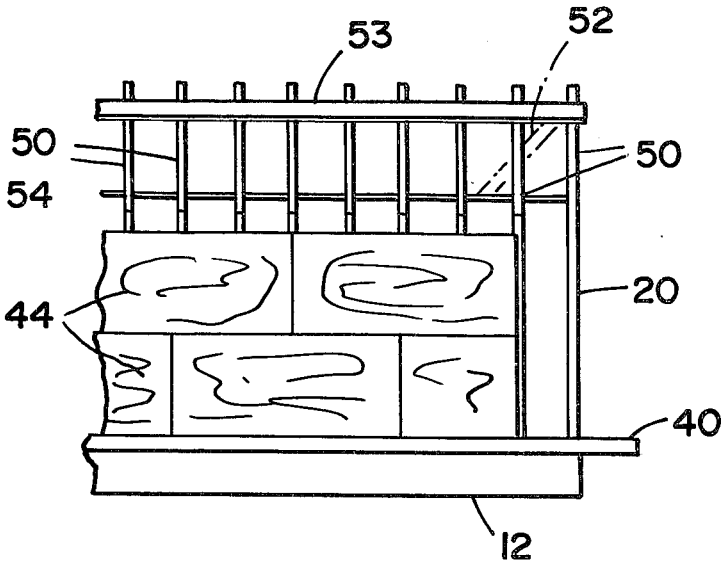
FIG. 12 is a fragmentary side view in elevation similar to FIG. 9 but showing a plurality of roof trusses in place and temporarily braced.
Figure 13:
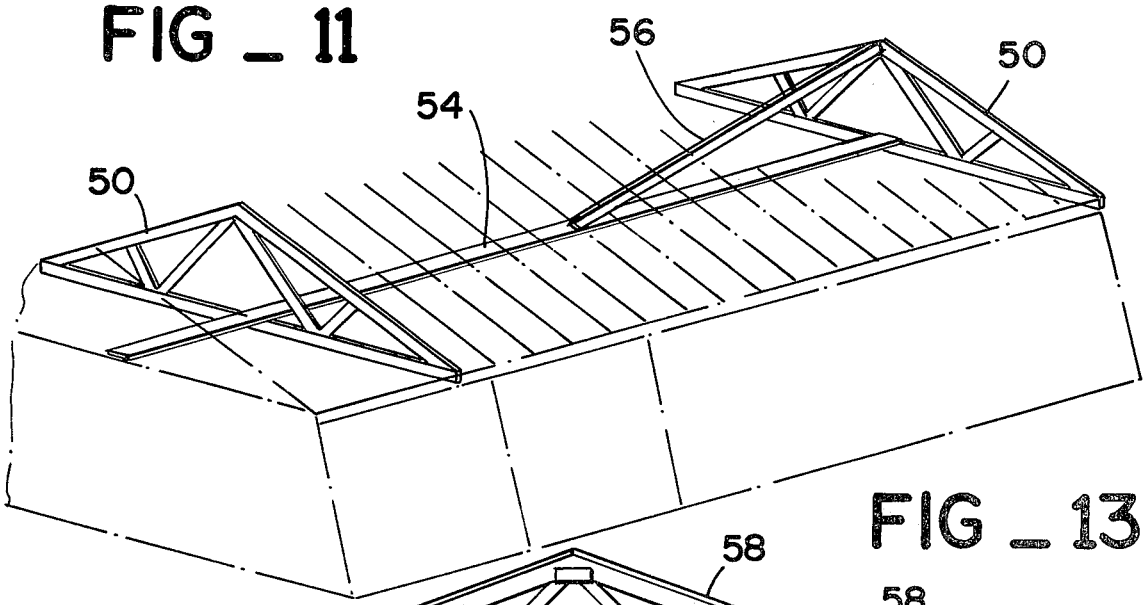
FIG. 13 is a perspective view partially in phantom illustrating the roof truss catwalk and sway brace arrangement according to this invention.
Figure 14:
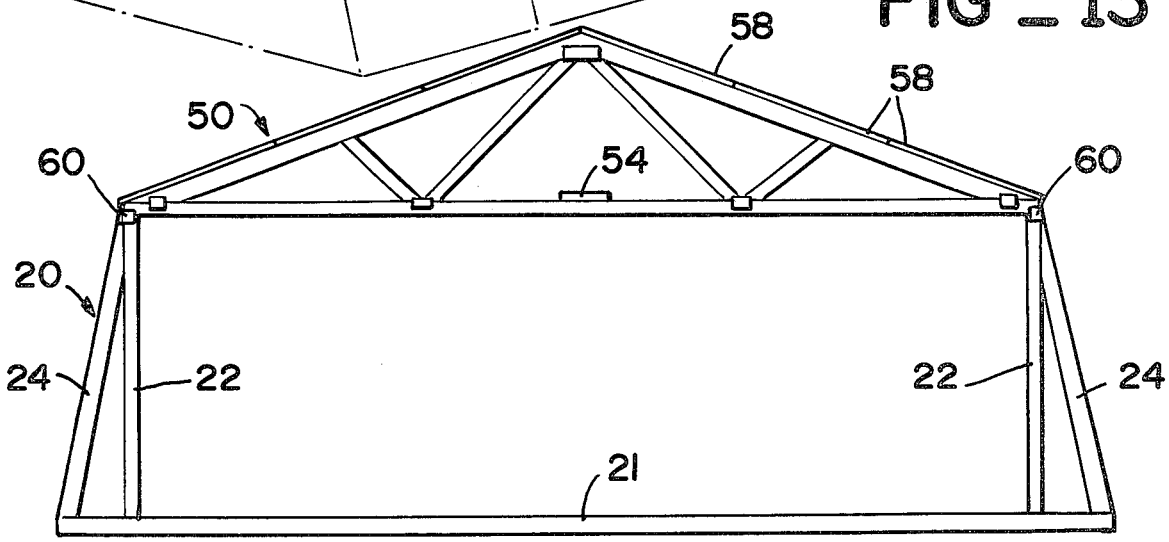
FIG. 14 is an end view in elevation illustrating the interconnection of the roof trusses with the joist trusses.

With the pre-framed side walls 13 and end walls 14 installed and the interior walls 48 framed, the structure is now ready for the installation of the gable trusses 50, as shown in FIGS. 12, 13 and 14. The gable trusses 50 may be of any conventional prefabricated type designed by the manufacturer to accommodate the applicable span and rood loading. As shown in FIGS. 12–14, a gable truss 50 is provided for each joist truss 20, 20' or joist member 20''.

The installation of the gable trusses 50 is carried out in much the same manner as the installation of the joist trusses. Thus, beginning at one end of the structure, the end gable truss 50 is positioned on the end joist truss 20 and end wall 14, held in place by a temporary brace 52 and toenailed as necessary.

A second gable truss 50 is then positioned on the second joist truss and a temporary nailer 53 is applied near the peak of the gable trusses and extending to overlap additional gable trusses as installed. Certain of the gable trusses will be supported at one or both ends on the side walls 13 but the great majority of the gable trusses will be supported at both ends on a joist truss 20.

After all of the gable trusses 50 have been positioned and held in place by means of the temporary nailer and temporary end braces, a catwalk 54 extending the length of the structure may be positioned on the gable trusses 50, as best shown in FIG. 13, and rigidly affixed thereto. A permanent sway brace 56 may then be rigidly fixed between the end gable trusses 50 and the catwalk 54, as best shown in FIG. 13.

According to the preferred embodiment of this invention, the ends of the gable trusses 50 are then rigidly fixed to the supporting ends of the joist trusses 20 by means of commercially available truss connector plates 60 of the type used in prefabricating the gable trusses 50. The gable trusses 50 which are supported at one or both ends on the side walls 13 should be rigidly interconnected therewith through the use of appropriate means such as commercially available framing anchors, for example.

If an overhang is to be provided at the ends of the structure, the end gable trusses 50 may be notched and 2 inch × 4 inch (5.1 cm × 10 cm) outlookers installed between the first and second gable trusses at each end of the structure to support the varge. Commercially available plywood sheets 58 may then be applied to the exterior of the gable trusses 50 interconnecting them into a rigid structure as described in connection with the joist trusses 20. The temporary nailer 53 may be removed when the last row of plywood sheets is applied at the peak of the gable trusses 50 thus insuring that proper positioning of the gable trusses 50 will be maintained.

After the sheeting of the roof and exterior side walls has been completed, an appropriate roofing may be applied to the sheets 44 and 58, as best shown in FIG. 1. Thus, it will be seen that a unitized exterior shell of great strength is provided according to the teaching of this invention. The resulting structure is particularly suited for use where heavy roof loading is anticipated such as in remote locations in the mountains where heavy snows are experienced.

The finishing of the interior of the structure may be carried out in the conventional manner including the installation of wall and overhead insulation. It is noted that the dead air space provided between the studs 22 and exterior wall members 24 not only contributes to the insulating characteristics of the structure but also facilitates the installation of plumbing, heating conduits and electrical wiring. It will be noted that it is unnecessary to bore or notch the studs 22 or exterior wall members 24 thus preserving the structural integrity of the joist trusses 20 and contributing to the strength of the structure.

It has been found that a structure constructed in accordance with the teaching of this invention requires much less energy to heat that structures constructed in accordance with the teaching of the prior art. Energy savings greater than 20% have been experienced. It has also been found that structures constructed in accordance with the teaching of this invention require less building materials. Actual calculations have shown that a 20% saving in building materials for a building constructed according to the teaching of this invention over a building of comparable size of conventional construction may be realized without sacrificing structural integrity.

What is claimed is:

1. The method of constructing a building comprising the steps of:

a. fabricating a plurality of first joist trusses each comprising a joist member of given common length having a floor supporting surface, a first pair of elongated wall members of given common length each extending normally to said floor supporting surface of said joist member and each having one end rigidly fixed to said joist member at a point spaced a given common distance from a different end of said joist member, and a second pair of elongated wall members extending only between the free end of a different one of said first pair of elongated wall members and the free end of said joist member adjacent thereto and being rigidly fixed at its ends to said elongated wall member and said joist member respectively;

b. fabricating a plurality of conventional gable trusses each having a span capable of bridging the spacing between said first pair of elongated wall members of each of said plurality of joist trusses;

c. arranging said plurality of first joist trusses with said joist members thereof parallel to each other in a horizontal plane with their ends in alignment and with the first elongated wall members thereof extending vertically;

d. applying conventional sheeting to the exterior surfaces of said second elongated wall members of said plurality of joist trusses and a conventional subfloor to said floor supporting surfaces of said joist members to form an open-end, open-top, box-like structure;

e. installing conventional interior wall framing and conventional exterior end walls in said box-like structure;

f. assembling each of said plurality of gable trusses with a different one of said plurality of joist trusses in vertically spaced parallel relation to the joist member thereof and with the ends of said gable truss in abutment with the ends of the elongated wall members thereof and rigidly fixing the ends of said gable truss to the abutting ends of said elongated wall members;

g. applying conventional sheeting to the exterior surfaces of said gable trusses; and h. applying conventional roofing to the sheeting of said roof and walls and finishing the interior of said structure.

2. The method of constructing a building as claimed in claim 1 including the step of providing a foundation structure having continuous support members underlying said first pair of elongated wall members of said plurality of joist trusses.

3. The method of constructing a building as claimed in claim 1 including the step of fabricating a second joist truss comprising a joist member having a floor supporting surface and a length less than said common length of said joist members of said first joist trusses by said given common distance, a first elongated wall member having a length equal to said given common length of said first pair of elongated wall members of said first joist trusses extending normally to said floor supporting surface of said joist member of said second joist truss and having one end rigidly fixed to said floor supporting surface of said joist member at a point spaced said given common distance from one end thereof, and a second elongated wall member extending only between and rigidly fixed at its opposite ends to the free ends of said first elongated wall member and said joist member of said second joist truss, respectively; and the step of a substituting said second joist trusses for one of said first joist trusses other than at an end of said building with said first elongated wall member thereof in alignment with said first elongated wall members of said first joist trusses.

4. The method of constructing a building as claimed in claim 1 including the step of fabricating a simple joist member having a length less than said common length of said joist members of said first joist trusses by twice said given common distance and substituting said simple joist member for one of said first joist trusses other than at an end of said building with the center of said simple joist member in alignment with the centers of the joist members of the remaining ones of said first joist trusses in said building.

5. The method of constructing a building as claimed in claim 2 including the step of providing a foundation structure having continuous support members underlying the joist members of the ones of said first joist trusses at the ends of said building.

6. The method of constructing a building as claimed in claim 5 including the step of providing a plurality of spaced parallel elongated filaments extending under said plurality of joist trusses and fixed at their opposite ends to said continuous support members underlying the joist members of the ones of said first joist trusses at the ends of said building.

7. The method of constructing a building as claimed in claim 1 including the step of installing a plurality of blocks extending between said joist members of adjacent ones of said first joist trusses.

8. The method of constructing a building as claimed in claim 4 including the step of fabricating a further simple joist member and rigidly fixing said further simple joist member to the joist member of the one of said first joist trusses at an end of said building with the centers thereof in alignment.

9. The method of constructing a building as claimed in claim 1 including the step of positioning an elongated sway brace member at an angle with respect to the vertical and normally to the length of said joist members of said first joist trusses within the volume defined by said first wall members and said second wall members fixed thereto of a number of said first joist trusses at an end of said building and rigidly fixing said sway brace member to said number of said first joist trusses.

10. The method of constructing a building as claimed in claim 1 including the step of positioning an elongated sway brace member at an angle with respect to the vertical and normally to the length of said joist members of said first joist trusses within the volume defined by said gable trusses at an end of said building and rigidly fixing one end of said sway brace member at the peak of the one of said gable trusses at said end of said building and the other end of said sway brace to a gable truss spaced from said end of said building.

11. For use in constructing a building, a prefabricated joist truss comprising a joist member having a floor supporting surface, a first elongated wall member extending normally to said floor supporting surface of said joist member and having one end rigidly fixed to said floor supporting surface of said joist member at a point spaced a given distance from one end thereof, and a second elongated wall member extending only between the free end of said first elongated wall member and said one end of said joist member, the opposite ends of said second elongated wall member being rigidly fixed to said free end of said first elongated wall member and said one end of said joist member, respectively.

12. For use in constructing a building a prefabricated joist truss as claimed in claim 11 wherein a third elongated wall member extends normally to said floor supporting surface of said joist member and has one end rigidly fixed to said floor supporting surface of said joist member at a point spaced said given distance from the other end thereof, and a fourth elongated wall member extends only between the free end of said third elongated wall member and said other end of said joist member, the opposite ends of said fourth elongated wall number being rigidly fixed to said free end of said third elongated wall member and said other end of said joist member respectively.

13. For use in constructing a building a prefabricated joist truss as claimed in claim 12 wherein said joist member and said elongated wall members are made of wooden timbers rigidly interconnected by metallic members driven thereinto at the joints therebetween.

14. A building structure including:

a. a first plurality of prefabricated joist trusses each comprising a joist member of given common length, a first pair of elongated wall members of given common length each extending normally to said length of said joist members and each having one end rigidly fixed to said joist member at a point spaced a given common distance from a different end of said joist member, and a second pair of elongated wall members each extending only between the free end of a different one of said first pair of elongated wall members and the free end of said joist member adjacent thereto and being rigidly fixed at its ends to said first elongated wall member and said joist member respectively; and b. a second plurality of prefabricated joist trusses each comprising a short joist member having a length less than the length of said joist members of said first plurality of prefabricated joist trusses by said given common distance, a first elongated wall member having a length equal to said given common length of said first pair of elongated wall members of said first plurality of joist trusses extending normally to the length of said short joist member and having one end rigidly fixed to said short joist member at a point spaced from one end thereof by said given common distance, and a second elongated wall member extending only between the free end of said first elongated wall member and said one end of said short joist member with the opposite ends thereof rigidly fixed to said first wall member and said short joist member respectively; and c. a plurality of prefabricated gable trusses each overlying a different one of said joist trusses of said first and second plurality of joist trusses with the free ends of said elongated wall members of said joist trusses rigidly fixed to the adjacent ends of the one of said gable trusses associated therewith.

15. A building structure as claimed in claim 14 wherein said second plurality of prefabricated joist trusses are adjacent each other in said building structure with their said one ends in alignment and a pre-framed side wall is rigidly mounted between the other ends of short joist members of said second plurality of prefabricated joist trusses and the ones of said gable trusses associated therewith.

* * * * *

UNITED STATES PATENT OFFICE

CERTIFICATE OF CORRECTION

Patent No. 4,073,103 Dated February 14, 1978

Inventor(s) CHARLES MICHAEL McCLURE

It is certified that error appears in the above-identified patent and that said Letters Patent are hereby corrected as shown below:

Column 6, line 7, - change "rood" to --roof--;
Column 7, line 9, - change "that" to --than--;
Column 8, line 23, - delete "a" before "substituting";
Column 9, line 34, - change "number" to --member--;
Column 10, line 41, - insert --said-- after "of" at the end of the line.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*